US009713834B2

(12) United States Patent
Gesuita

(10) Patent No.: US 9,713,834 B2
(45) Date of Patent: Jul. 25, 2017

(54) PUNCHING APPARATUS

(71) Applicant: SALVAGNINI ITALIA S.P.A., Sarego (VI) (IT)

(72) Inventor: Enzo Gesuita, Selvazzano Dentro (IT)

(73) Assignee: SALVAGNINI ITALIA S.P.A., Sarego (VI) (IT)

( * ) Notice: Subject to any disclaimer, the term of this patent is extended or adjusted under 35 U.S.C. 154(b) by 0 days.

(21) Appl. No.: 15/318,382

(22) PCT Filed: Jun. 12, 2015

(86) PCT No.: PCT/EP2015/063212

§ 371 (c)(1),
(2) Date: Dec. 13, 2016

(87) PCT Pub. No.: WO2015/189408

PCT Pub. Date: Dec. 17, 2015

(65) Prior Publication Data

US 2017/0120320 A1 May 4, 2017

(30) Foreign Application Priority Data

Jun. 13, 2014 (EP) ..... 14172392

(51) Int. Cl.
*B21D 11/22* (2006.01)
*B21D 28/34* (2006.01)
(Continued)

(52) U.S. Cl.
CPC ..... *B21D 28/343* (2013.01); *B21D 28/04* (2013.01); *B21D 28/26* (2013.01)

(58) Field of Classification Search
CPC .... B21D 28/0343; B21D 28/04; B21D 28/26; B26D 7/22
(Continued)

(56) References Cited

U.S. PATENT DOCUMENTS 2,458,160 A 1/1949 Grappe
6,644,080 B2 * 11/2003 Lindstrom ..... B21D 5/002 72/19.4
(Continued)

FOREIGN PATENT DOCUMENTS

| | | |
|---|---|---|
| CN | 102909255 | 2/2013 |
| EP | 1 245 356 | 10/2002 |
| EP | 1 445 042 | 8/2004 |

OTHER PUBLICATIONS

International Search Report issued Sep. 30, 2015 in International (PCT) Application No. PCT/EP2015/063212.

*Primary Examiner* — David B Jones
(74) *Attorney, Agent, or Firm* — Wenderoth, Lind & Ponack, L.L.P.

(57) ABSTRACT

A punching apparatus includes punching tools and actuators positioned above and aligned with the respective punching tools to actuate the punching tools along an operating direction so as to interact with a piece to be worked. The punching tools and the actuators are arranged side by side along at least one row. The punching apparatus includes at least one barrier optical sensor, suitable to generate a light beam that is put side by side to the row of punching tools and actuators, and reference elements, each of which is associated to a respective punching tool and/or actuator to intercept the light beam. The barrier optical sensor is arranged to detect changes in the light beam produced by one of the reference elements moving along the operating direction so as to measure a position and/or a stroke and/or a speed of a punching tool associated to the reference element.

15 Claims, 3 Drawing Sheets

(51) Int. Cl.
*B21D 28/04* (2006.01)
*B21D 28/26* (2006.01)

(58) Field of Classification Search
USPC ..... 72/15.3
See application file for complete search history.

(56) References Cited

U.S. PATENT DOCUMENTS

| | | | | |
|---|---|---|---|---|
| 8,061,027 | B2 * | 11/2011 | Garner, Jr. ..... | H01R 43/055 29/566.2 |
| 8,356,500 | B2 * | 1/2013 | Werner ..... | B44B 3/009 72/16.1 |
| 2002/0139233 | A1 | 10/2002 | Yasoda et al. | |
| 2012/0186408 | A1 * | 7/2012 | Vogt ..... | F16P 3/144 83/13 |

* cited by examiner

PUNCHING APPARATUS

The invention relates to punching machines to work pieces and/or metal sheets. Particularly, the invention relates to a so-called multi-press punching apparatus associable to a punching machine and provided with a plurality of punching tools and sensors to detect position and stroke of all said punching tools.

Punching machines are known, which are provided with apparatuses or multi-press punching heads, i.e. comprising a plurality of tools or punches arranged adjacent and side by side so as to form a structure with dies in parallel rows and linearly actuated so as to interact with the piece to be worked by respective presses, typically composed of hydraulic linear actuators (hydraulic cylinders). In such machine, the punching apparatus comprises all the tools necessary to carry out the required processing operations on the piece sequentially. In this manner, it is not needed to carry out tool exchange operations during the manufacturing cycle, this allowing eliminating both the downtimes for replacing the tool (thereby increasing the machine efficiency) and the automatic devices for preparing and replacing the tools (thus simplifying the machine structure).

In order to properly carry out the processing operations on the piece, it is necessary to control the position, and particularly, the operative stroke and the speed of each tool, since position, stroke, and speed depend on, and are a function of, the thickness and the material of the piece to be worked and/or the kind of processing to be performed.

However, due to the overall dimensions and costs, it is not possible to provide a measurement sensor for each punching tool; therefore, alternative solutions have been developed and applied in the known punching machines.

For example, patent EP 1445042 of the same applicant discloses a measurement device that is applied to a multi-press punching head, which comprises a position transducer associated, via a mono-directional mechanical connection, to a plurality of hydraulic cylinders, each of which being connected to and acting on a respective punching tool. More precisely, each cylinder is connected through the respective piston to a mobile equipment of the transducer by means of an arm. In this manner, the transducer detects the stroke of any of the pistons, hence of the respective tool, while the rest of the pistons (and tools) remains inactive.

This solution allows, with a reduced number of measuring sensors, detecting the position and stroke of all the punching head tools. However, such solution is complex and expensive in the manufacturing and structure thereof.

An object of the present invention is to improve the known multi-press punching apparatuses, provided with a plurality of punching tools and associable to punching machines for working pieces and/or metal sheets.

Another object is to achieve a punching apparatus provided with sensors that allow detecting and measuring in a fast, simple and accurate manner position, stroke and speed of all the punching tools during the operation thereof.

A further object is to achieve a punching apparatus provided with sensors for measuring position, stroke, and speed of all the punching tools having a simple construction and reduced costs.

Still another object is to achieve a punching machine having a punching apparatus provided with sensors that allow detecting and measuring in a fast, easy and accurate manner position, stroke, and speed of each punching tool of said punching apparatus. These and other objects are achieved by a punching apparatus according to claim 1.

The punching apparatus of the invention, thanks to the barrier optical sensors, such as in particular laser through beam sensors, allows in a simple but accurate and reliable manner, detecting and measuring in real time and dynamically during the operation thereof the position, stroke or displacement and speed of the punching tool that is used at the time during the processing. Therefore, it is possible for a control unit of the punching apparatus, or of the punching machine on which the punching apparatus is installed, precisely actuating and controlling the actuator that moves the activated punching tool so that the latter moves with a stroke and a speed that are appropriate for the processing to be performed and/or the mechanical characteristics of the piece to be worked (material, thickness, etc.).

The installation of the barrier optical sensors on the punching apparatus is easy, since it does not require particular mechanical and/or structural modifications of the latter. Furthermore, it is possible with only one barrier optical sensor to measure the displacements of a plurality of actuators and relative punching tools, this allowing limiting the costs and simplifying the assembling and setting of the punching apparatus.

The invention will be better understood and implemented with reference to the attached drawings, which illustrate an exemplifying, non-limiting embodiment thereof, in which.

Figure 1:
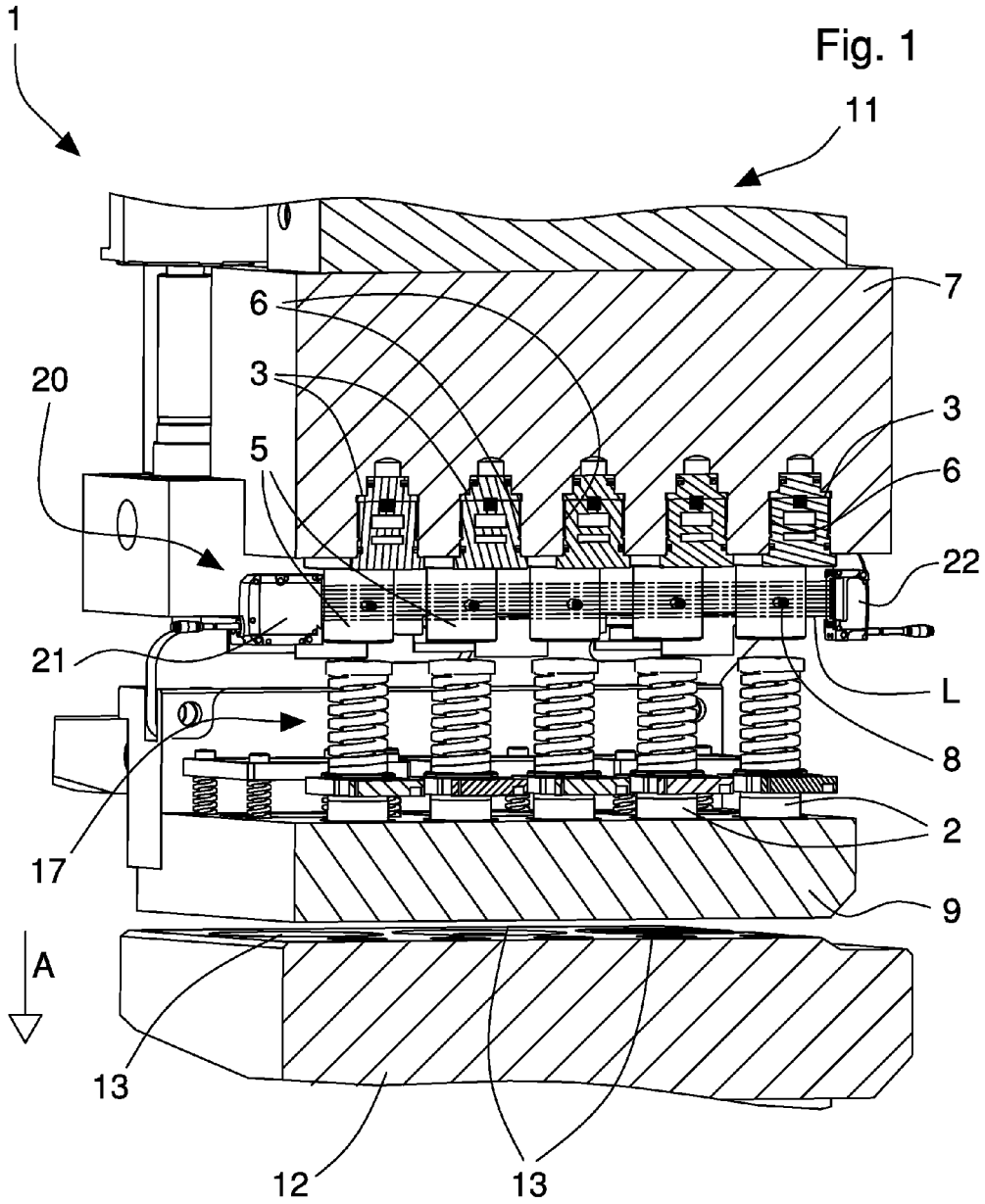
FIG. 1 is a partial, perspective and partially sectioned view of the punching apparatus of the invention.
Figure 2:
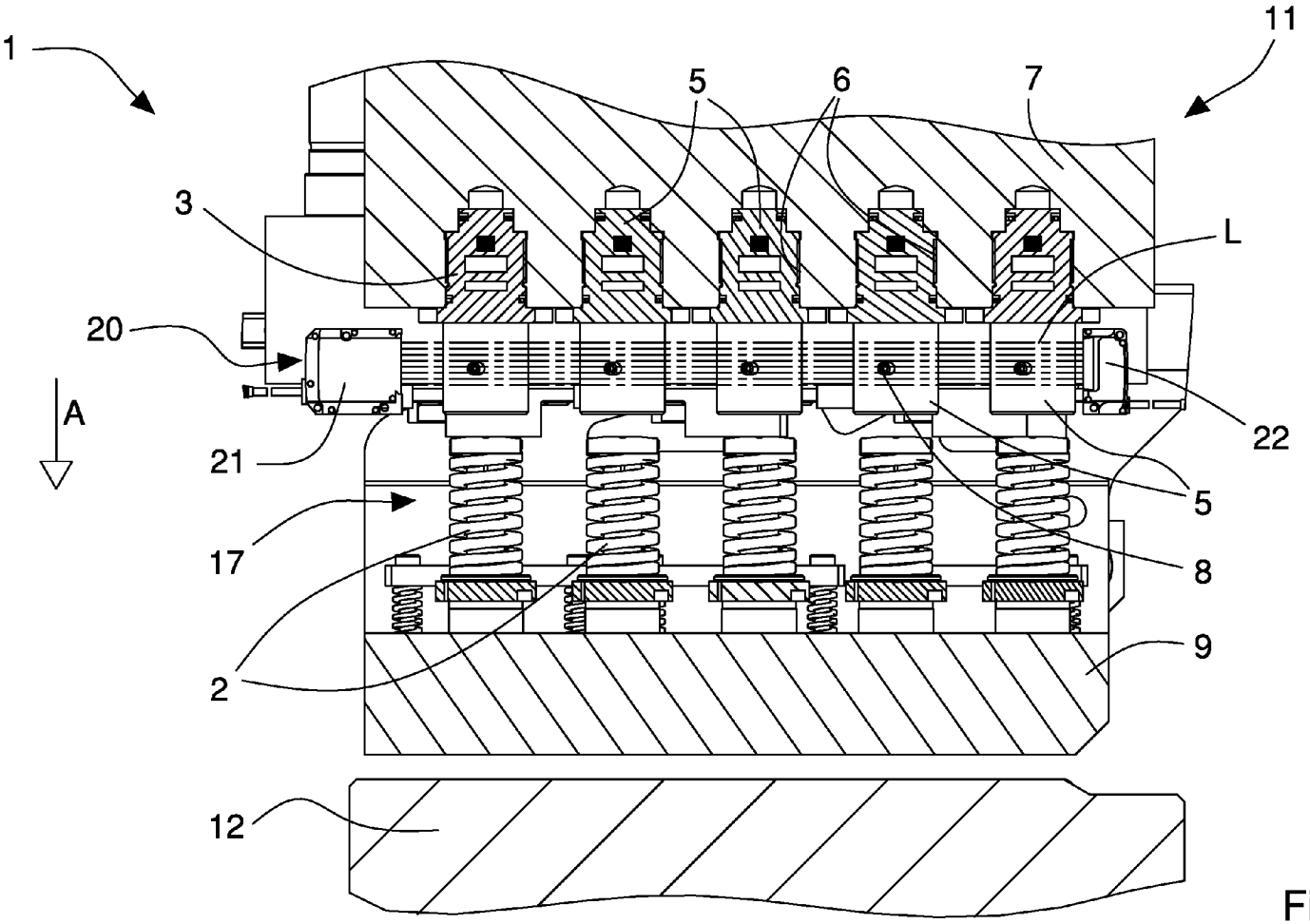
FIG. 2 is a cross-section of the apparatus of FIG. 1.
Figure 3:
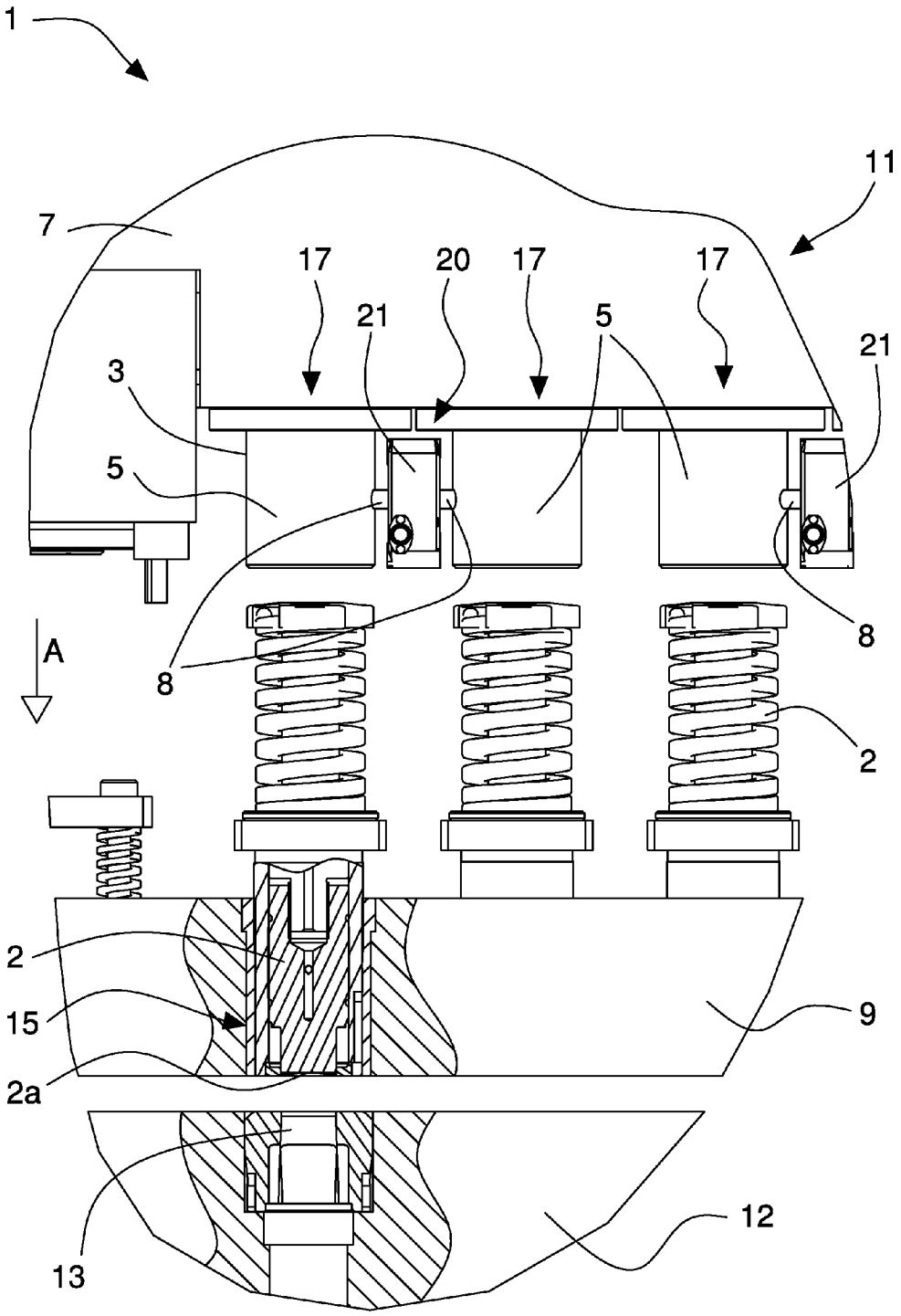
FIG. 3 is a partial, enlarged, and partially sectioned side view of the apparatus of FIG. 1.

With reference to the FIGS. 1 to 3, a punching apparatus 1 is illustrated that is associable to a punching machine, not shown, and is suitable to work pieces and/or metal sheets. The punching apparatus 1, of the so-called multi-press type, comprises a plurality of punching tools 2 and a plurality of respective actuators 3 positioned above, and aligned with, the respective punching tools 2 in order to actuate the latter ones along an operating direction A so that the above-mentioned tools 2 interact with a piece to be worked. The punching tools 2 and the respective actuators 3 above are arranged side by side to form one or more adjacent and parallel rows 17, in particular so as to form a die structure composed of plurality of rows 17 put side by side. More precisely, the punching apparatus 1 comprises a multi-press punching head 11 that includes the plurality of tools 2 and the plurality of actuators 3, and a multi-die unit 12 provided with a plurality of dies or counter-punches 13 suitable to cooperate with the respective punching tools 2 to carry out cuts and/or punching operations onto the piece to be worked.

The punching apparatus 1 comprises at least one barrier optical sensor 20 capable of generating a light beam L substantially flat and linear, adjacent and put side by side to, in particular almost parallel to, the row 17 of the punching tools 2 and the actuators 3. The apparatus also comprises a plurality of reference elements 8, each of which being associated to a respective punching tool 2 or a respective actuator 3, and arranged to intercept or interrupt the light beam L.

In fact, the laser through beam sensor 20 is capable of detecting changes in the light beam L caused by one of the reference elements 8 in movement, so as to allow detecting and measuring a position, a stroke, and a speed of a punching tool 2 associated with the said reference element 8, as better explained in the description herein below.

In the embodiment illustrated in the figures, the reference elements 8 are associated to the actuators 3 that move the respective punching tools 2. By detecting the position and stroke of the actuators 3, it is possible to calculate the position and stroke of the punching tools 2.

Alternatively, the reference elements 8 can be directly fixed to the punching tools 2. The light beam L has such a height or width as to be always intercepted or partially interrupted by the reference elements 8, whichever the position taken by the punching tools 2 and the respective actuators 3 is. In this manner, as better explained in the description herein below, the light beam L is intercepted by the reference elements 8 along the entire stroke of the punching tools 2.

The barrier optical sensor 20 comprises, in particular, a laser through beam sensor, of a known type and commercially available, which generates a laser light beam or laser beam L. The laser beam L forms a rectilinear and flat, substantially two-dimensional barrier, which is parallel to the row 17 of punching tools 2 and actuators 3, and parallel to the operating direction A. More precisely, the laser beam F lies on a plane that is parallel to the row 17 of punching tools 2 and actuators 3, and parallel to the operating direction A; in the illustrated embodiment, such plane is further substantially vertical and orthogonal to the piece to be worked.

Figure 4:
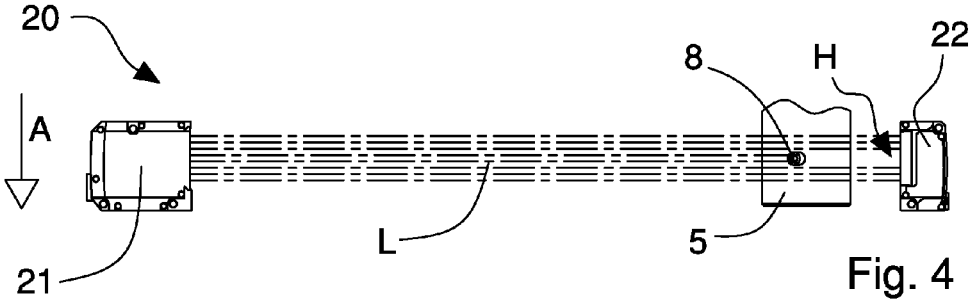
FIG. 4 is a front view of a barrier optical sensor of the apparatus of FIG. 1 associated to a reference element.

With reference to FIG. 4, the laser through beam sensor 20 comprises an emitter 21 capable of emitting the laser beam L in a flat and linear shape and a receiver 22 capable of receiving such laser beam L and detecting changes in the latter that are produced by a barrier member 8 moving through said laser beam L. In fact, the receiver 22 comprises a CCD (Charge Coupled Device) or L-CCD (Linearized-Charge Coupled Device) linear image sensor, also referred to as CCD or L-CCD linear sensor array, which is lightened by the laser beam L generated by the emitter 21, and it is capable of detecting the width and distribution of the laser beam L front. As illustrated in FIG. 4, when the laser beam L intercepts a reference element 8, the front of said laser beam L lighting the receiver 22 has a darkened zone or shadow zone H that indicates the position of the reference element 8 along the operating direction A orthogonal to said laser beam L. The receiver 22 is capable of detecting the position and width of such shadow zone H, i.e. the position and dimension of the reference element 8. The receiver 22 is also capable of detecting changes over time in the position of the s H, i.e. of detecting displacements or strokes of said shadow zone, hence of the reference element 8.

According to the sensitivity of the CCD linear image sensor of the receiver 22, it is possible to detect the position and stroke of the reference element 8 with a more or less high precision and accuracy.

The actuators 3 comprise respective beating elements 5 linearly movable along the operating, typically vertical, direction A, and acting on the respective punching tools 2. The reference elements 8 comprise reference pins fixed to respective outer side walls of the beating elements 5. The reference pins 8 are fixed to the beating elements 5 almost orthogonally to the operating direction A.

The actuators 3 comprise, for example, hydraulic cylinders and the beating elements 5 comprise pistons of said hydraulic cylinders. In particular, the punching head 11 comprises an upper block 7 in which chambers 6 of the hydraulic cylinders are obtained inside which the respective pistons 5 slide.

The punching tools 2 are slidably housed in, and supported by, a support plate 9 of the punching head 11 connected to the upper block 7.

In the illustrated embodiment, the punching apparatus 1 comprises a plurality of punching tools 2 and respective actuators 3 arranged along a plurality of adjacent and parallel rows 17 and a plurality of laser through beam sensors 20, each of which is so arranged as to generate a respective laser beam L that is interposed between and passing through two rows 17 of adjacent actuators 3. In this manner, the laser through beam sensor 20 is capable of detecting and measuring the position and stroke of each of the actuators 3 (hence, of the punching tool 2 actuated by said actuator 3) present in the two adjacent and facing rows 17 (FIG. 3).

The laser through beam sensors 20 are connected to a control unit, not illustrated, of the punching apparatus 1 or of the punching machine, to which they send signals relating to a position and/or a stroke or a displacement of the punching tools 2 in an operative step of the apparatus 1. In this manner, the control unit can control in feedback and in real time the actuators 3 that actuate the punching tools 2 in order to adjust position, speed, and acceleration thereof, and generally a law of motion.

The operation of the punching apparatus 1 of the invention provides using individually a punching tool 2 to carry out the required processing on the piece. However, it is provided that a plurality of punching tools 2, belonging to different rows 17 that are associated to separate laser through beam sensors 20, can be simultaneously actuated to carry out respective processing operations on the piece in the same step.

In an inactive configuration of the apparatus 1, all the actuators 3 are disengaged from the respective punching tools 2 and the beating elements 5 are partially retracted inside the upper block 7.

To carry out the required processing, the actuator 3 corresponding to the punching tool 2 necessary for said processing is actuated. The beating element 5 of the actuator 3 is moved along the operating direction A until hammering and moving the punching tool 2. The latter slides inside a respective seat 15 carried out in the support plate 9 of the punching head 11 until hitting the piece to be worked (not shown) with an operative end 2*a*.

The displacement of the beating element 5, hence of the actuated punching tool 2, is detected by the laser through beam sensor 20. The laser beam L of the latter is, in the inactive configuration of the apparatus 1 and in the illustrated embodiment, intercepted or interrupted by all the reference elements 8 of the actuators 3 mutually aligned. However, the reference element 8 associated to the moving actuator causes a variation on the laser beam L that is detected by the receiver 22 of the laser through beam sensor 20. More precisely, the CCD linear image sensor of the receiver 22 detects the increase in the dimensions and/or the displacement of the shadow zone H of the front of said laser beam L caused by the movement of the reference element 8. Therefore, the laser through beam sensor 20 detects and measures the displacement of the reference element 8, i.e. the displacement and the stroke of the relative punching tool 2 along the operating direction A. The laser through beam sensor 20 further sends a signal relating to such displacement to the control unit, which is thus capable of adjusting and controlling the operating of the actuator 3 that moved the activated punching tool 2.

Alternatively, the reference elements 8 and the laser through beam sensor 20 can be positioned so that, in the inactive configuration of the apparatus 1, the laser beam L are not intercepted or interrupted by the reference elements 8. In this case, the movement of one of the reference elements 8 determines the laser beam L variation, particularly the formation and displacement of a shadow zone H of the front of said laser beam L that lightens the receiver 22.

The punching apparatus 1 of the invention thanks to the barrier optical sensors 20, and in particular laser through beam sensors, allows in a simple but accurate and reliable manner, detecting and measuring in real time and dynamically during the operation of the punching machine the position, stroke, and speed of the punching tool 2 that is used at the time during the processing. Therefore, it is possible for the control unit of the apparatus or of the punching machine to precisely actuate and control the actuator 3 of the activated punching tool 2, so that the latter moves with optimal stroke and speed, that are appropriate for the processing to be performed and/or the mechanical and physical characteristics of the piece to be worked (material, thickness, etc.).

It should be noted that the installation of the barrier optical sensors 20 is very easy, since it does not require particular mechanical and/or structural changes, in particular of the punching head 11. Furthermore, by only one barrier optical sensor 20 it is possible to measure the displacements of a plurality of actuators 3 and respective punching tools 2 (the tools arranged on two rows 17 placed side by side), this allowing reducing the cost and simplify the assembling and setting of the punching apparatus 1.

The invention claimed is:

1. A punching apparatus comprising:

a plurality of punching tools;

a plurality of actuators positioned above and aligned respectively with said punching tools to actuate said punching tools along an operating direction so as to interact with a piece to be worked;

at least one barrier optical sensor; and a plurality of reference elements, wherein said punching tools and said actuators are arranged side by side along at least one row, said at least one barrier optical sensor is operable to generate a light beam, said at least one barrier optical sensor being located side by side to said row of punching tools and actuators, each of said plurality of reference elements is associated to a respective one of said punching tools and/or actuators in order to intercept the light beam, and said at least one barrier optical sensor is arranged to detect changes in the light beam produced by one of said reference elements that moves along the operating direction so as to measure a position and/or a stroke and/or a speed of one of said punching tools associated with said one of said reference elements.

2. The punching apparatus according to claim 1, wherein said at least one barrier optical sensor comprises a laser through beam sensor that generates a laser light beam.

3. The punching apparatus according to claim 1, wherein the light beam has a flat and linear shape and lies on a plane almost parallel to said row of punching tools and actuators and to the operating direction.

4. The punching apparatus according to claim 1, wherein the light beam has such a width as to intercept said reference elements during an entire stroke of a respective one of said punching tools.

5. The punching apparatus according to claim 1, wherein said at least one barrier optical sensor comprises an emitter operable to generate the light beam and a receiver operable to receive the light beam and to detect changes in the light beam that are produced by movement of one of said reference elements.

6. The punching apparatus according to claim 2, wherein said at least one barrier optical sensor comprises an emitter operable to generate the light beam and a receiver operable to receive the light beam and to detect changes in the light beam that are produced by movement of one of said reference elements, said receiver comprising a Charge Coupled Device (CCD) or Linearized-Charge Coupled Device (L-CCD) linear image sensor illuminated by the laser light beam.

7. The punching apparatus according to claim 1, wherein said actuators comprise respective beating elements that are linearly movable along the operating direction and operate respectively on said punching tools, and said reference elements comprise reference pins fixed to outer side walls of said respective beating elements.

8. The punching apparatus according to claim 7, wherein said actuators comprise hydraulic cylinders and said beating elements comprise pistons of said hydraulic cylinders.

9. The punching apparatus according to claim 1, wherein said plurality of punching tools and said plurality of respective actuators are arranged along at least two adjacent and parallel rows, and said at least one barrier optical sensor is operable to generate the light beam interposed between and passing through said two adjacent rows of punching tools and actuators.

10. The punching apparatus according to claim 9, wherein said at least one barrier optical sensor comprises a plurality of barrier optical sensors, each of which is operable to generate a respective light beam and interposed between and passing through two adjacent rows of said punching tools and actuators.

11. The punching apparatus according to claim 1, further comprising a multi-press punching head that includes said plurality of punching tools, said plurality of actuators and a multi-die unit provided with a plurality of dies that cooperate with said respective punching tools to carry out processing operations on the piece.

12. The punching apparatus according to claim 1, further comprising a control unit connected to said at least one barrier optical sensor and arranged to receive signals relating to the position and the stroke of said one of said punching tools and to control in feedback and in real time one of said actuators that drives said one of said punching tools, by controlling and adjusting at least one of position, speed and acceleration of said one of said actuators.

13. A punching machine for metal sheets, the punching machine comprising at least one punching apparatus according to claim 1, which includes said plurality of punching tools and said plurality of respective actuators.

14. The punching machine according to claim 13, further comprising a control unit connected to said at least one barrier optical sensor of said punching apparatus in order to receive signals relating to a position and/or a stroke of said punching tools in an operative step of said punching machine and to control in feedback and in real time said actuators actuating said punching tools.

15. The punching machine according to claim 14, wherein said control unit is operable to control and adjust at least one of position, speed, and acceleration of said actuators.

* * * * *